US011000137B2

(12) United States Patent
Barnes

(10) Patent No.: US 11,000,137 B2
(45) Date of Patent: May 11, 2021

(54) MIRROR FRAMING KIT

(71) Applicant: Sarah C. Barnes, Milton (CA)

(72) Inventor: Sarah C. Barnes, Milton (CA)

( * ) Notice: Subject to any disclaimer, the term of this patent is extended or adjusted under 35 U.S.C. 154(b) by 0 days.

(21) Appl. No.: 16/105,123

(22) Filed: Aug. 20, 2018

(65) Prior Publication Data

US 2019/0053644 A1 Feb. 21, 2019

Related U.S. Application Data

(60) Provisional application No. 62/547,872, filed on Aug. 20, 2017.

(51) Int. Cl.

| | |
|---|---|
| ***A47G 1/10*** | (2006.01) |
| ***A47G 1/06*** | (2006.01) |
| ***A47G 1/02*** | (2006.01) |

(52) U.S. Cl.

CPC ..... *A47G 1/10* (2013.01); *A47G 1/02* (2013.01); *A47G 1/06* (2013.01); *A47G 1/0605* (2013.01)

(58) Field of Classification Search

CPC ... A47G 1/10; A47G 1/06; A47G 1/02; A47G 1/0605; F16B 21/08; F16B 2200/10; A47F 1/10; Y10T 403/72

See application file for complete search history.

(56) References Cited

U.S. PATENT DOCUMENTS

| | | | | | |
|---|---|---|---|---|---|
| 3,311,338 | A * | 3/1967 | Culley | A47B 91/06 | 248/205.3 |
| 3,336,689 | A * | 8/1967 | Miller | A47G 1/102 | 40/782 |
| 3,855,754 | A * | 12/1974 | Scoville | E06B 3/9845 | 403/295 |
| 4,033,060 | A * | 7/1977 | Lawrence | A47G 1/141 | 40/746 |
| 4,063,378 | A * | 12/1977 | Burke | A47G 1/06 | 40/757 |
| 4,332,495 | A * | 6/1982 | Burgers | A47G 1/10 | 403/376 |
| 6,865,836 | B2 * | 3/2005 | Sachs-Lavery | A47G 1/08 | 248/467 |
| 8,092,114 | B2 * | 1/2012 | Baur | E05B 63/123 | 403/254 |
| 2002/0170216 | A1 * | 11/2002 | Pearce | A47G 1/02 | 40/597 |
| 2005/0055907 | A1 * | 3/2005 | Huntting | A47G 1/0605 | 52/204.1 |
| 2006/0042141 | A1 * | 3/2006 | Hansen | E04B 2/7422 | 40/782 |
| 2015/0345532 | A1 * | 12/2015 | Baur | F16B 12/26 | 403/326 |

* cited by examiner

*Primary Examiner* — Cassandra Davis

(74) *Attorney, Agent, or Firm* — Ingenium Patents LLC; Peter R Kramer

(57) ABSTRACT

A mirror framing kit for forming a frame around an existing mirror mounted to a support structure without having to remove the existing mirror from the support structure.

6 Claims, 5 Drawing Sheets

MIRROR FRAMING KIT

CROSS-REFERENCE TO RELATED APPLICATION

The present application is related to and claims priority from prior provisional application Ser. No. 62/547,872, filed Aug. 20, 2017 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of frame devices and more specifically relates to a mirror framing kit for forming a frame around an existing mirror mounted to a support structure without having to remove said existing mirror from said support structure.

2. Description of the Related Art

Picture frames have traditionally been made of wood, which is still the most common material, although other materials are used including silver, bronze, aluminum, and plastics such as polystyrene. A picture frame may be of any color or texture, and many different shapes and sizes and having an article framed in a framing shop such as a mirror can be very costly. It can also be inconvenient and costly and dangerous to take the mirror off the wall and take it to the framing shop or replace a builder's mirror with an already framed mirror.

Various attempts have been made to solve problems found in frame art. Among these are found in: U.S. Pat. No. 7,770,315 to Bauer et al; U.S. Publication No. 2005/0055907 to Huntting et al.; and U.S. Pat. No. 6,347,472 to Ana M. Dominguez. This prior art is representative of mirror frames.

Ideally, a mirror framing kit for forming a frame around an existing mirror mounted to a support should be user-friendly and safe in-use and yet would operate reliably and be manufactured at a modest expense. Thus, a need exists for a mirror framing kit for forming a frame around an existing mirror mounted to a support structure without having to remove the existing mirror from the support structure and to avoid the above-mentioned problems.

BRIEF SUMMARY OF THE INVENTION

In view of the foregoing disadvantages inherent in the known of frame device art, the present invention provides a novel mirror framing kit. The general purpose of the present invention, which will be described subsequently in greater detail is to provide a mirror framing kit for forming a frame around an existing mirror mounted to a support structure without having to remove the existing mirror from the support structure.

A mirror framing kit for forming a frame around an existing mirror mounted to a support structure, comprising: four elongated frame members, each including an axis along a length thereof; a proximal end; a distal end; and four releasable connector members. The proximal end including a straight edge portion forming an angle with respect to said axis and a slot therein adapted to releasably hold a releasable connector therein. The distal end includes a straight edge portion forming an angle with respect to said axis and a slot therein adapted to releasably hold a releasable connector therein.

Wherein the sum of the angle of the straight edge of said proximal end and the angle of the straight edge of the distal end equals 90 degrees. Wherein each straight edge of the proximal end of each elongated frame member is adapted to releasably connect with a respective straight edge of a distal end of an adjacent the elongated frame member via the slots and releasable connector members, such that the four elongated frame members are adapted to form a rectangular frame. Wherein the releasable connector members are adapted to fit within and releasably connect with respective adjacent slots of the four elongated frame members to thereby form the rectangular frame. Wherein the mirror framing kit is used to form a frame around an existing mirror mounted to a support structure without having to remove the existing mirror from the support structure.

The present invention holds significant improvements and serves as a mirror framing kit. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, a Mirror Framing Kit, constructed and operative according to the teachings of the present invention.

The various embodiments of the present invention will hereinafter be described in conjunction with the appended drawings, wherein like designations denote like elements.

DETAILED DESCRIPTION

Figure 1A:
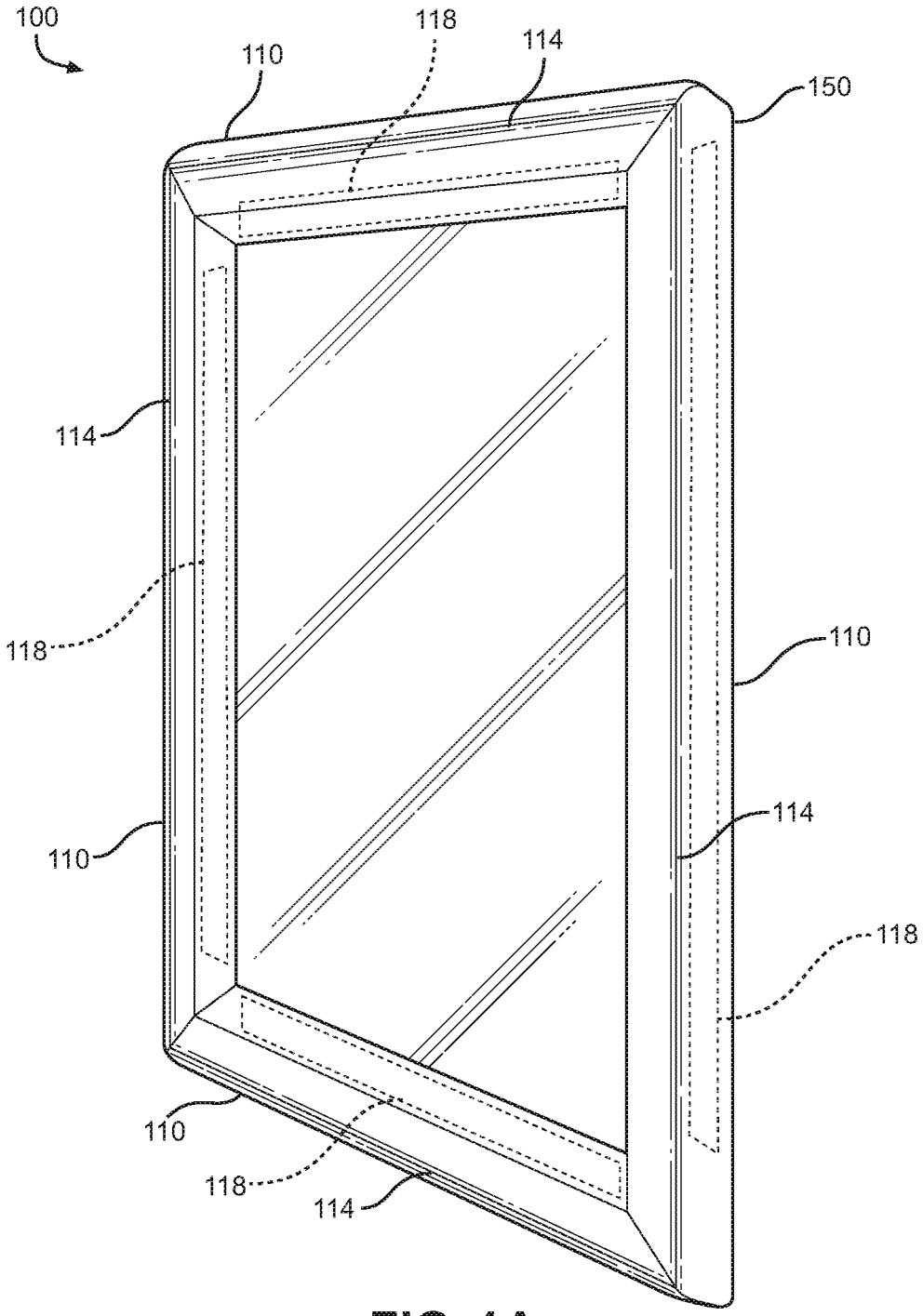
FIG. 1A shows a front perspective view illustrating a mirror framing kit for forming frame around an existing mirror mounted to a support structure according to an embodiment of the present invention.
Figure 1B:
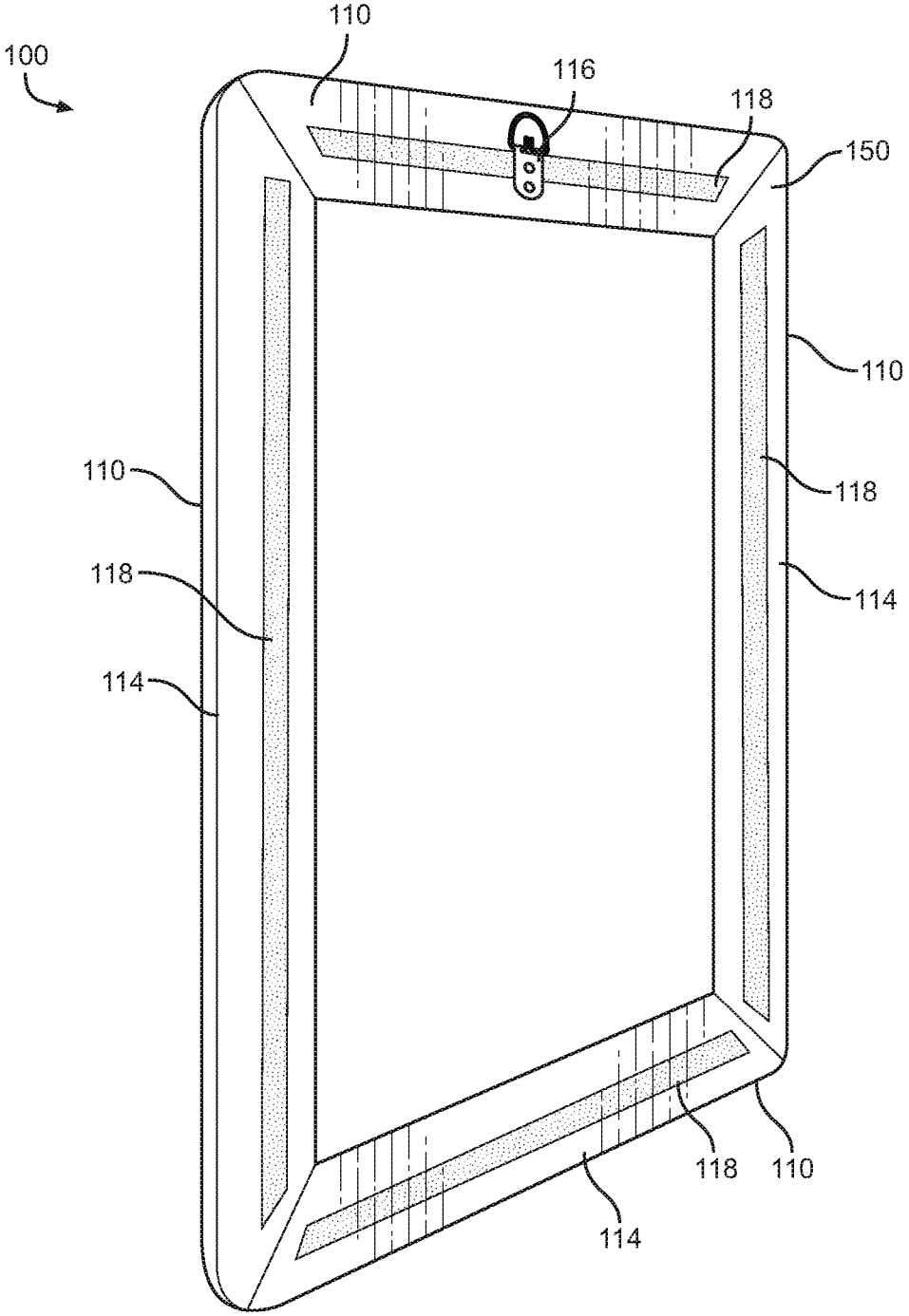
FIG. 1B shows a back perspective view illustrating a mirror framing kit for forming frame around an existing mirror according to an embodiment of the present invention.

As discussed above, embodiments of the present invention relate to a frame device and more particularly to a mirror framing kit for forming a frame around an existing mirror mounted to a support structure without having to remove the existing mirror from the support structure. Various colors and texture designs can create the desired impression or match existing furniture colors. The present invention may be a classic, minimalist design to elevate and improve any interior space. The components of the present invention may also disassemble into a flat pack of light weight parts for easy shipping and storage.

Referring to the drawings by numerals of reference there is shown in FIGS. 1-4, perspective views illustrating mirror framing kit 100 for forming frame 150 around an existing mirror 160 mounted to a support structure according to an embodiment of the present invention.

Figure 2:
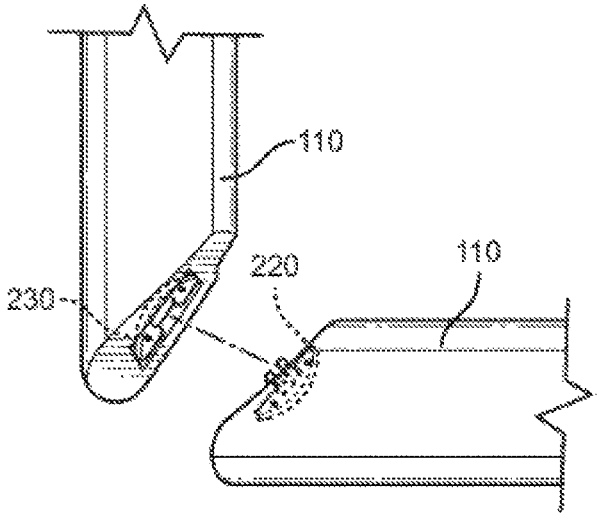
FIG. 2 is a perspective view illustrating releasable connector members that when mated together form an oval of the mirror framing kit according to an embodiment of the present invention of FIG. 1.

A mirror framing kit 100 for forming frame 150 around existing mirror 160 mounted to a support structure, comprising: four elongated frame members 110, each including axis 114 along a length thereof; proximal end 310; distal end 350; and four releasable connector members 200. Wherein four elongated frame members 200 are formed having a trapezoidal shape as shown in FIG. 2. Wherein four elongated frame members 110 are formed from a material chosen from a group of materials consisting of wood, metal, and plastic.

Figure 3:
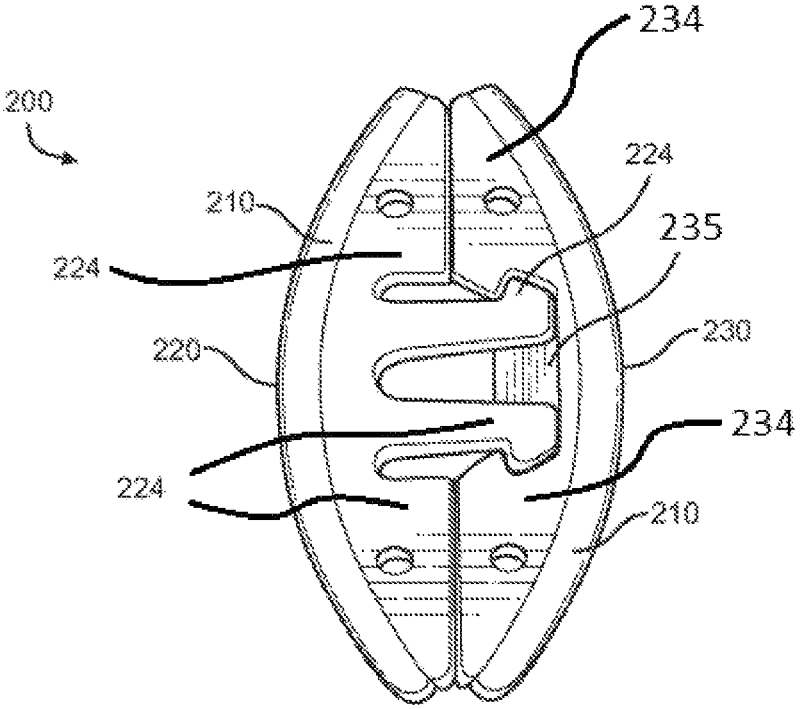
FIG. 3 and FIG. 5 represents perspective views illustrating four releasable connector members that when mated together form an oval of the and mirror framing kit that when disassembled, respectively, according to an embodiment of the present invention of FIG. 1.
Figure 4:
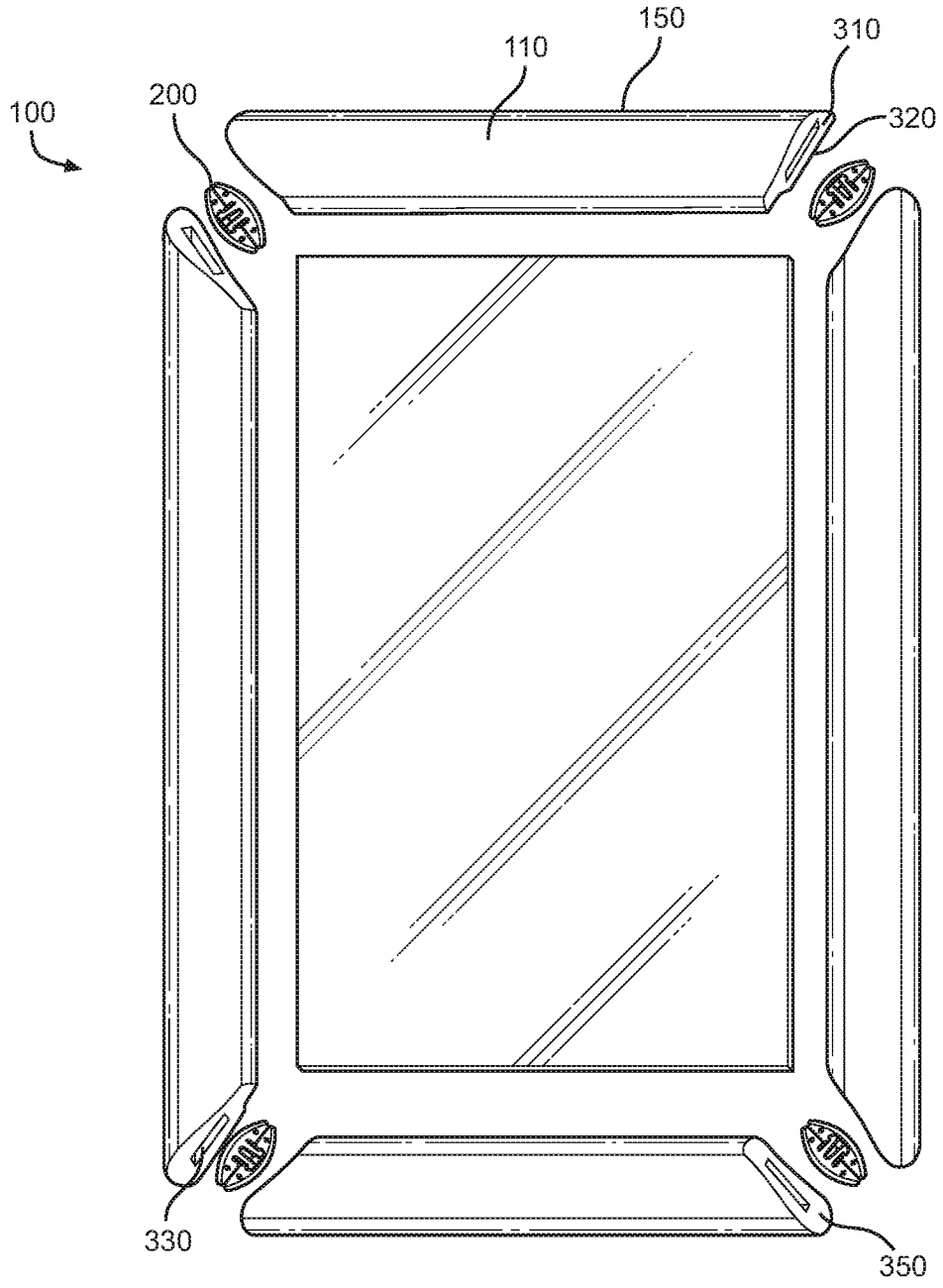
FIG. 4 is a perspective view illustrating four elongated frame members and four releasable connector members in an un-assembled condition of the mirror framing kit according to an embodiment of the present invention of FIG. 1.
Figure 5:
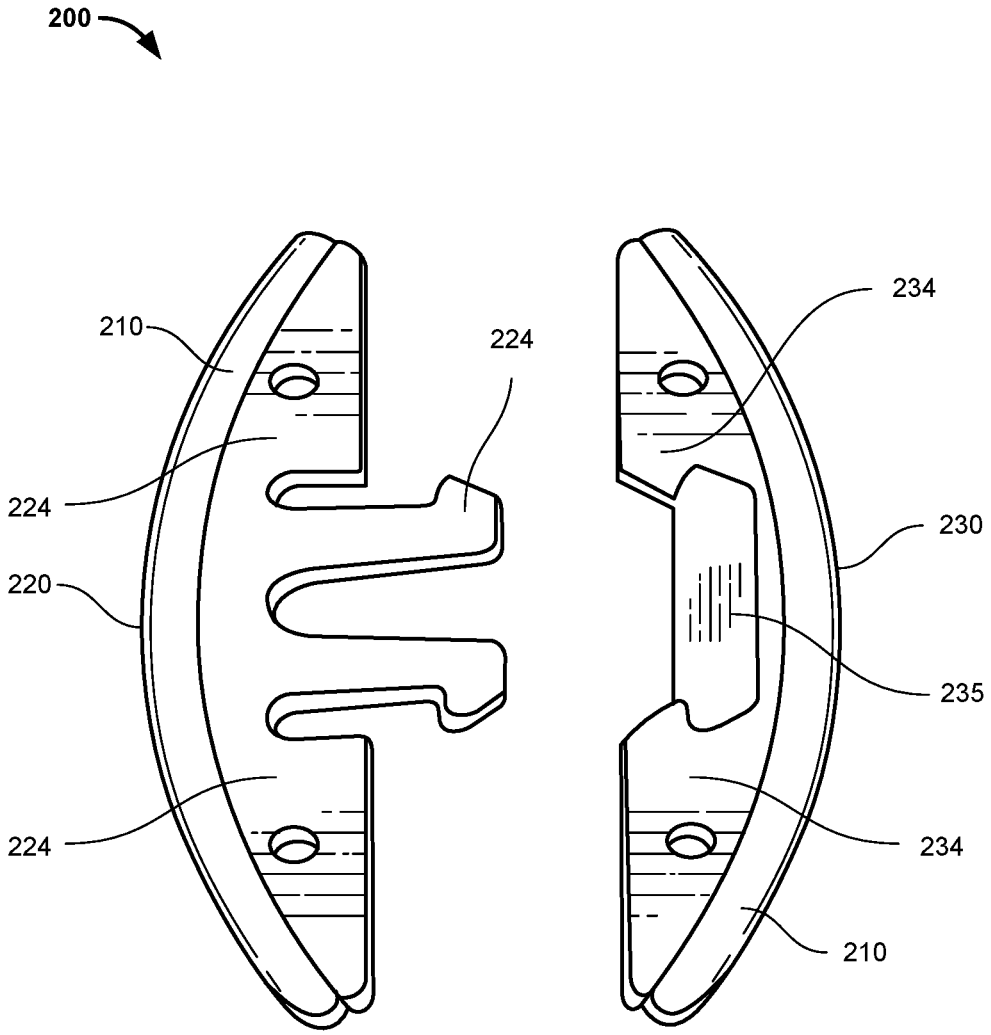

Proximal end 310 includes straight edge portion 320 forming an angle with respect to axis 114 and slot 330 therein adapted to releasably hold releasable connector 200 therein. Distal end 350 includes straight edge portion 360 forming an angle with respect to axis 114 and slot 370 therein adapted to releasably hold releasable connector 200 therein.

Wherein the sum of the angle of the straight edge of proximal end and the angle of the straight edge of the distal end equals 90 degrees. Wherein each straight edge of the proximal end 310 of elongated frame member 110 is adapted to releasably connect with a respective straight edge of distal end 350 of an adjacent elongated frame member 110 via slot 330 of proximal end 310 and slot 370 of distal end 350 of releasable connector members 200, such that four elongated frame members 110 are adapted to form a rectangular frame as shown in FIG. 1. Wherein releasable connector members 200 are adapted to fit within and releasably connect with respective adjacent slot 330 of proximal end 310 and slot 370 of distal end 350 of the four elongated frame members 110 to thereby form the rectangular frame.

Wherein each of four releasable connector members 200 are formed from two connector halves 210 releasably connected to one another; and wherein each connector half 210 is adapted to fit within and releasably connect with a respective slot of each of proximal end 310 and distal end 350 of four elongated frame members 110. Wherein each of four releasable connector members 200 are formed from a metallic material.

Wherein first 220 of two connector halves 210 includes at least one resilient clip member thereon 224; and second 230 of two connector halves 210 includes at least one resilient clip member 234 thereon adapted to releasably connected with resilient clip member 224 of first connector half 220 and of second connector half 230. The resilient clip member 234 has a recess portion 235, as illustrated in FIG. 5, to receive at least one resilient member 224. The recess portion 235 is a hollow grooved portion where the at least one resilient member 224 is engaged with at least one resilient member 234. Wherein each connector half 210 is fit within and releasably connected with a respective slot 330 of proximal end 310 and slot 370 of distal end 350 of four elongated frame members 110, such that four elongated frame members 110 can be releasably connected together upon and around edges of existing mirror 150, and such that when desired four elongated frame members 110 can then be released from one another to take apart mirror frame 100 and remove from the edges of existing mirror 150. Wherein each said connector half 210 is fit within and releasably connected with a respective slot 330 of proximal end 310 and slot 370 of distal end 350 of four elongated frame members 110 via friction. Wherein each connector half 210 is formed having a half-oval shape, such that when two connector halves 210 are connected together they form an oval-shape as shown in FIG. 2. Wherein each connector half 210 is formed having a half-circle shape, such that when two connector halves 210 are connected together they form a circle-shape as shown in FIG. 3. Wherein resilient clip member 224 of first 220 of two connector halves 210 and resilient clip member 234 of second 230 of two connector halves 210 are adapted to be connected together via a pushing force, and detached from one another via a pulling force. Wherein each of four releasable connector members 200 are formed from a plastic material.

Wherein the mirror framing kit 100 is used to form frame 150 around existing mirror 160 mounted to a support structure without having to remove the existing mirror 160 from the support structure. Mirror framing kit 100 further comprising at least one hanging clip 116 attached to one of four elongated frame members 110 and adapted to releasably clip to an upper edge of existing mirror 160 to thereby releasably hold frame 150 upon existing mirror 160 as show in FIG. 1B. Mirror framing kit 100 further comprising at least one adhesive strip 118 attached to one of four elongated frame members 110 and adapted to releasably connect to an edge of existing mirror 160 to thereby releasably hold frame 150 upon existing mirror 160.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

I claim:

1. A mirror framing kit for forming a frame around an existing mirror mounted to a support structure, said mirror framing kit comprising, four elongated frame members and four releasable connector members, wherein:

each of said four elongated frame members includes:

an axis along a length thereof;

a proximal end including:

a straight edge portion forming an angle with respect to said axis; and a slot therein adapted to releasably hold one of said four releasable connector members therein;

a distal end including:

a straight edge portion forming an angle with respect to said axis; and a slot therein adapted to releasably hold one of said four releasable connector members therein;

wherein the sum of said angle of said straight edge of said proximal end and said angle of said straight edge of said distal end equals 90 degrees; and wherein each said straight edge of said proximal end of each said elongated frame member is adapted to be releasably connect with a respective said straight edge of a distal end of an adjacent said elongated frame member via said slots and four releasable connector members, such that said four elongated frame members are adapted to form a rectangular frame; and said four releasable connector members;

wherein said releasable connector members are adapted to fit within and releasably connect with respective adjacent slots of said four elongated frame members to thereby form said rectangular frame;

wherein each of said four releasable connector members are formed from two connector halves releasably connected to one another;

wherein a first of said two connector halves includes at least one resilient clip member thereon; and a second of said two connector halves includes at least one resilient clip member thereon adapted to releasably connect with said resilient clip member of said first of said two connector halves; and wherein resilient clip members are adapted to be connected together via a pushing force, and detached from one another via a pulling force, wherein each said connector half is fit within and releasably connected with a respective slot of each of said proximal and distal ends of said four elongated frame members via friction;

at least one hanging clip, said at least one hanging clip attached to one of said four elongated frame members and adapted to releasably clip to an upper edge of the existing mirror thereby releasably holding the frame upon the existing mirror whereby said frame can be formed around the existing mirror before or after the existing mirror is attached to the support structure;

means for adhesively attaching at least one of said elongated frame members wherein said means for adhesively attaching at least one of said elongated frame members is adapted to releasably hold said frame upon the existing mounted mirror.

2. The mirror framing kit of claim 1, wherein said four elongated frame members are formed having a trapezoidal shape.

3. The mirror framing kit of claim 1, wherein each of said four releasable connector members are formed from a plastic material.

4. The mirror framing kit of claim 1, wherein each said connector half is fit within and releasably connected with a respective slot of each of said proximal and distal ends of said four elongated frame members, such that said four elongated frame members can be releasably connected together upon and around edges of said existing mirror, and such that when desired said four elongated frame members can then be released from one another to take apart said mirror frame and remove from said edges of said existing mirror.

5. The mirror framing kit of claim 4, wherein each said connector half is formed having a half-oval shape, such that when said two connector halves are connected together they form an oval-shape.

6. The mirror framing kit of claim 4, wherein each said connector half is formed having a half-circle shape, such that when said two connector halves are connected together they form a circle-shape.

* * * * *